United States Patent [19]

Ryan

[11] Patent Number: 4,631,754

[45] Date of Patent: Dec. 30, 1986

[54] NURSING SCARF

[76] Inventor: Barbara D. Ryan, 2529 Holkham Dr., Charlottesville, Va. 22901

[21] Appl. No.: 681,625

[22] Filed: Dec. 14, 1984

[51] Int. Cl.[4] ..... A41D 1/20

[52] U.S. Cl. ..... 2/104

[58] Field of Search ..... 2/104, 207, 198, 203, 2/204, 48

[56] References Cited

U.S. PATENT DOCUMENTS 2,674,738 4/1954 Mehlos ..... 2/48

3,238,536 3/1966 Gettinger ..... 2/207

*Primary Examiner*—Doris L. Troutman

*Attorney, Agent, or Firm*—Cushman, Darby & Cushman

[57] ABSTRACT

A nursing scarf of trapezoidal shape to be worn about the neck of a nursing mother over her primary articles of clothing which provides complete privacy from the public eye throughout the nursing process by shielding the mother's breast and midriff, while still affording eye contact between mother and infant by means of a pleating system which creates an opening or window at the top of the scarf.

1 Claim, 4 Drawing Figures

NURSING SCARF

The present invention is concerned with a novel type of scarf characterized by its trapezoidal shape and otherwise designed to be used for the discreet nursing of an infant.

SUMMARY OF THE INVENTION

The primary object of the invention is to provide a compact, supplemental item of clothing, i.e. a nursing scarf, to be worn over the nursing mother's normal, everyday primary clothing beneath which an infant can affix himself or herself to the mother's breast in complete privacy, while still allowing the mother to maintain important, nurturing eye contact with the infant.

For centuries nursing mothers have endeavored to nurse their infants discreetly in public. The prevailing method has been to drape the mother's shoulder, breast and nursing infant's head with a diaper, blanket, or other suitable article. This "method" has several disadvantages. The first is that the drape often falls off or is pulled off by the infant. Another disadvantage is that the infant's face is covered and the desired "nurturing" eye contact with the mother is prevented. A still further disadvantage is that the draping material can cause the nursing infant and/or the nursing mother to overheat.

The present invention obviates the above-mentioned disadvantages in that the present nursing scarf cannot fall or be pulled off by the nursing infant as it is affixed about the nursing mother's neck. Additionally, it provides an opening or "window" through which mother and infant can maintain eye contact during a nursing session by virtue of a system of medial pleats in the scarf. Finally, this same system of pleats insures adequate ventilation so that neither mother nor baby overheat.

PRIOR ART

Although there are many patents pertaining to primary articles of clothing designed to facilitate nursing, all of these appear to require the mother's breast to be protruded through a pleat, flap, slit, pocket or other opening at the beginning of the nursing process. Two recent examples are U.S. Pat. 4,004,294, issued to L. Pinch on Jan. 25, 1977, and U.S. Pat. 4,031,566, issued to M. Johnson on June 28, 1977. Both of these patents pertain to primary articles of clothing, specifically, shirts, to be worn by a nursing mother in lieu of her normal, everyday clothing; further, both require the nursing mother to protrude her breast through, in the one instance, a pocket, and in the other instance, a flap, in public view throughout the nursing process.

Two patents have been issued pertaining to secondary or supplemental articles of clothing designed to facilitate the nursing process. The first of these, U.S. Pat. 2,417,888, was issued on Mar. 25, 1946 to C. A. Schuster and discloses a vest to be worn as a supplemental article of clothing to protect the wearer's primary clothing from being soiled or stained during the burping procedure. The lower portion of the vest may be folded upwardly and outwardly to expose the mother's breast. to the nursing infant. Thus, this supplemental item of clothing designed to facilitate nursing does not overcome the objectionable public exposure of the nursing mother's breast throughout a nursing session.

The second patent pertaining to a supplemental article of clothing, U.S. Pat. 4,106,122, was issued on Aug. 15, 1978, to L. M. Dodd. This patent discloses a haltered apron intended to be worn over or under normal, everyday, primary clothing, which apron contains flaps and slits through which the breast is protruded to nurse an infant. Again, this supplemental item of clothing designed to facilitate nursing fails to overcome the objectionable public exposure of the nursing mother's breast during the nursing process.

OBJECTS AND ADVANTAGES OF THE INVENTION

This review of prior art reveals that both primary articles of clothing and secondary or supplemental articles of clothing designed to facilitate nursing require the nursing mother to expose her breast to the public eye during the nursing process. The present invention overcomes this objectionable public exposure, enabling the nursing mother to begin and complete the nursing process while in a public place without exposing her breast or bared midriff. A further advantage of the invention is that it allows the nursing mother to rearrange her primary articles of clothing and nursing brassiere fasteners both before and after nursing by merely slipping her arm beneath the draping provided by the scarf greatly facilitating discreet nursing in public. And, finally, the invention facilitates the nurturing of the suckling infant in that salubrious eye contact with the mother can be maintained throughout the nursing process. The invention thus creates a private domain within the public realm in which a mother can both nurse and nurture her infant.

BROAD DESCRIPTION OF THE INVENTION

The nursing scarf of the invention, broadly described, comprises a single piece of material of generally trapezoidal shape having substantially parallel top and bottom edges and side edges which extend downwardly and inwardly from the top edge to the lower edge, the top edge including a plurality of spaced pleats to facilitate contouring of the scarf when the ends of the top edge are joined for use.

BRIEF DESCRIPTION OF THE DRAWINGS

The invention is more fully described by reference to the accompanying drawings wherein.

DETAILED DESCRIPTION

Figure 1:
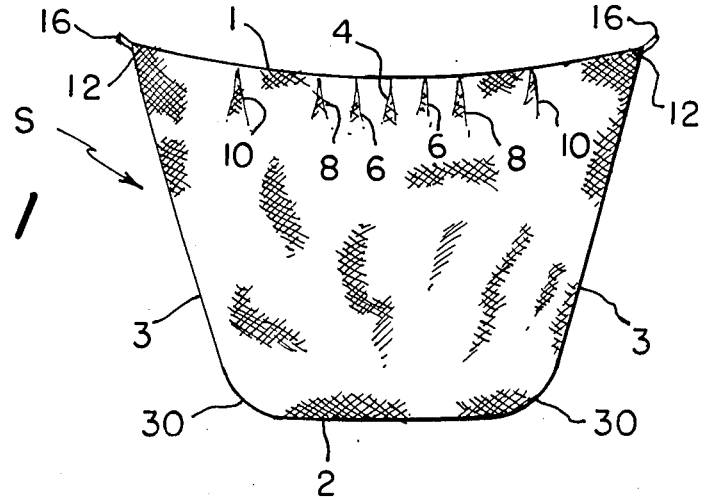
FIG. 1 is a plan view of the scarf of the present invention.

Referring more specifically to the drawings, the scarf shown in FIG. 1 comprises a trapezoidal piece (S) of fabric having parallel top and bottom edges (1) and (2), respectively, and side edges (3). As shown, the top edge (1), which is the longer of the edges (1) and (2), is provided with a series of spaced pleats (4), (6), (8) and (10). While the number and spacing of these pleats can be varied, they are preferably arranged as shown with the pleat (4) located in the center of the top edge (1), the two equally spaced pleats (6) and (8) positioned on both sides of central pleat (4) and the additional pleats (10)

spaced further outwards on the edge (1) approximately midway between the outermost corners (12) of the scarf and the pleats (8). This sort of positioning of the pleats helps to provide means for contouring the scarf when it is knotted or otherwise fastened and placed around the mother's shoulders. The pleats may be formed in any convenient fashion, generally by simply gathering together adjacent sections of the edge (1) and vertically stitching these together.

As noted, the outermost corners (12) of the top edge (1) of the scarf are intended to be secured together. While hooks, clasps, buckles or like fastening means can be employed, the easiest method for securing these outermost corners is to simply tie or knot them together. Small tabs or extensions (16) may also be provided for this purpose if desired although these are not in any sense essential.

As indicated earlier, pleat (4) is placed at the midpoint of the top edge (1) of the trapezoidal fabric while the pairs of pleats (6), (8) and (10) are, respectively, placed at equal distances outwardly from the midpoint pleat (4). This arrangement of the pleats creates a fullness beneath which a baby can nurse, as well as create a window or opening (W) as best shown in FIG. 3 through which the nursing mother can regard her suckling infant.

Figure 2:
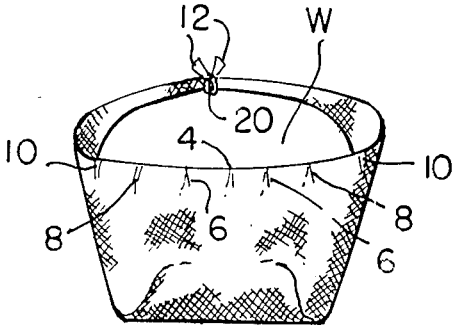
FIG. 2 is a perspective view of the scarf of FIG. 1 with ends knotted so that it may be slipped over the head of the nursing mother.

FIG. 2 shows the scarf of FIG. 1 with the corners (12) of the top edge knotted or otherwise affixed at (20). Knotting has a particular advantage, in that the fabric ends or corners (12) can be pulled through the knot (20) so that the knot comes to rest at the desired point. This permits shortening the available length of the horizontal top edge (1) of the nursing scarf. In this way, the scarf may be adjusted to fit a woman of slight build or narrow shoulders.

FIG. 2 also demonstrates the fullness at (24) created by the medial pleats (4), (6), (8) and (10). This fullness provides the space for the nursing infant's head to be placed at the mother's breast.

Figure 3:
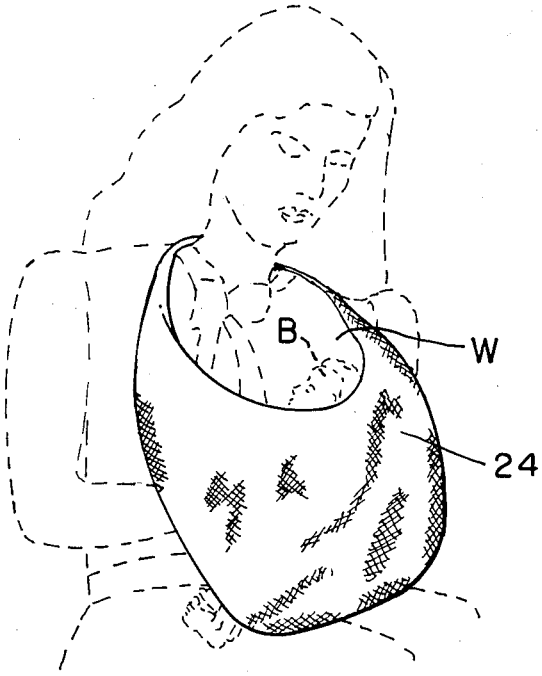
FIG. 3 shows the scarf of FIGS. 1 and 2 being worn by a nursing mother illustrating the "window" effect.

FIG. 3 shows the nursing scarf (1) draped across the mother's shoulders in use. As shown, the scarf serves to conceal the nursing process from the public gaze, while still affording eye contact between mother and infant (B) by means of the pleating system which creates the opening or window (W) at the top of the scarf.

Figure 4:
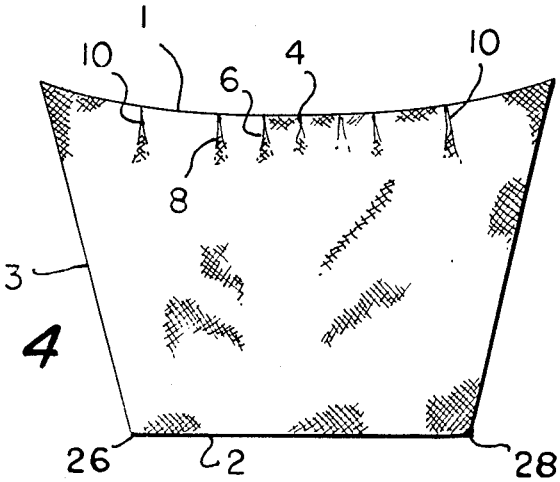
FIG. 4 is a plan view of modified version of the present scarf.

FIG. 4 shows a modification of the scarf of FIG. 1 wherein the bottom corners (26) and (28) are squared off. It is preferred, however, to use the rounded bottom corners (30) as shown in FIG. 1 while still retaining the essentially trapezoidal nature of the scarf. The rounded corners (30) shown in FIG. 1 offer a convenience in preparing the scarf in that the outer edges of the scarf can be provided with a hem along the side and bottom edges in a continuous sewing operation.

It will be appreciated that the dimensions of the scarf can be varied. Advantageously, however, the length of the top edge (1) is about three times the length of the bottom edge (2). Additionally, the distance between the parallel top and bottom edges, i.e. the vertical width of the scarf, is preferably ⅓–170 of the length of the top edge.

The scarf has been illustrated above with five medial pleats equally spaced in the central portion of the top edge (1). More or less than this number of such pleats, e.g. 3–7 pleats, can be used. However, it appears that an optional opening is obtained with five or so pleats as shown with one or two further pleats (10) more widely spaced from the central or medial pleats (4), (6), (8). Various types of pleats can be used although these preferably are kept as simple as possible.

The scarf may be made from any type of suitable textile or like. It is preferred however to use of fabric which is relatively lightweight and open.

Various other modifications may be made in the invention as described in the foregoing without departing from the scope thereof as defined in the following claims.

What is claimed is:

1. A method of nursing an infant which comprises providing a nursing scarf for the discreet nursing of an infant, said scarf being a single piece of material of generally trapezoidal shape having substantially parallel top and bottom edges and side edges which extend downwardly and inwardly from the top edge to the lower edge, the top edge including a plurality of spaced pleats along the top edge of the scarf in the central portion thereof to facilitate contouring of the scarf when the ends of the top edge are joined together for use, positioning the scarf so that it appears in front of the mother's chest area with the ends of the top edge of the scarf being joined together behind the mother's neck, placing the infant within the scarf adjacent the chest and nursing, the scarf being of such size, shape and contour as to conceal the infant as nursing proceeds while providing an opening for eye contact between the mother and infant.

* * * * *